US008262302B1

(12) United States Patent
Bouix et al.

(10) Patent No.: US 8,262,302 B1
(45) **Date of Patent: *Sep. 11, 2012**

(54) KIT FOR A HEATING APPLICATOR AND PRODUCT

(75) Inventors: Herve F. Bouix, New York, NY (US); Francis Corbellini, Thiais (FR); Christophe Jacob, Saint Denis le Thiboult (FR)

(73) Assignee: ELC Management LLC, Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/330,832

(22) Filed: Dec. 20, 2011

(51) Int. Cl.
*A46B 11/08* (2006.01)

(52) U.S. Cl. ..... 401/1; 401/118; 401/129; 401/268

(58) Field of Classification Search ..... 401/1–2, 401/38, 100, 118–119, 126–130, 191, 268, 401/292

See application file for complete search history.

(56) References Cited

U.S. PATENT DOCUMENTS

| | | | | |
|---|---|---|---|---|
| 7,108,438 | B2 * | 9/2006 | Fontaine | 401/1 |
| 7,374,358 | B2 * | 5/2008 | Neuner et al. | 401/126 |
| 7,448,814 | B2 * | 11/2008 | Bouix et al. | 401/2 |
| 7,753,609 | B2 * | 7/2010 | Bouix et al. | 401/129 |
| 8,142,090 | B2 * | 3/2012 | Kamada et al. | 401/1 |
| 2007/0286831 | A1 * | 12/2007 | Kamada et al. | 424/70.7 |
| 2009/0071501 | A1 * | 3/2009 | Gueret | 132/218 |
| 2011/0030713 | A1 * | 2/2011 | Gueret | 132/200 |
| 2011/0200381 | A1 * | 8/2011 | Bylsma et al. | 401/118 |
| 2011/0232671 | A1 * | 9/2011 | Bouix et al. | 132/218 |
| 2011/0233184 | A1 * | 9/2011 | Bouix et al. | 219/209 |
| 2012/0125950 | A1 * | 5/2012 | Bouix et al. | 222/146.5 |

* cited by examiner

*Primary Examiner* — David Walczak
*Assistant Examiner* — Bradley Oliver
(74) *Attorney, Agent, or Firm* — Peter Giancana

(57) ABSTRACT

A heating applicator kit for mascara or other products that tend to dry out or be adversely affected when heated. A kit comprises multiple reservoirs of product and at least one heating applicator that alleviates the problems associated with heat exposure in the reservoir and on the applicator head.

16 Claims, 8 Drawing Sheets

KIT FOR A HEATING APPLICATOR AND PRODUCT

FIELD OF THE INVENTION

The present invention is in the field of cosmetic and personal care products. In particular, the present invention concerns a heating applicator kit for mascara or other products that tend to dry out or be adversely affected when heated.

BACKGROUND

Heating mascara applicators have only recently begun to appear on the market, and their presence in the marketplace may grow significantly in years to come. In co-pending application U.S. Ser. No. 12/980,526, we explained that one impediment to market acceptance is lack of familiarity with heated mascara application, and we described a system for sampling a heated product at a store counter. In the present application we tackle another impediment to market acceptance; the problem of product dry-out as a result of repeated exposure to heat. Full size, salable mascara products may typically supply about 4 g to about 10 g of mascara. If a single use includes making up two eyes, then many full size saleable mascara products are used 100 times or more, before being discarded. However, it has been observed that after tens of uses, a heated applicator can cause the formula in the reservoir to dry out, rendering the mascara unusable. Furthermore, residual product that remains on the applicator head also dries out, and builds up on the working surface of the applicator. After just tens of uses of the applicator, this build up of dried out material interferes with the performance of the applicator. Thus, the customer is frustrated, and the benefits of a heated mascara have not been realized.

The problems just described are not limited to mascara. Any product that utilizes a heated applicator to deliver the formula may be degraded by too much exposure to heat. What is still needed then, is a way to provide a consumer with a saleable amount of cosmetic or personal care product for use with a heated applicator, while avoiding the problems associated with heat exposure in the reservoir and on the applicator head.

OBJECT OF THE INVENTION

A main object of the invention is to provide a kit comprising multiple reservoirs of product and at least one heating applicator that alleviates the problems associated with heat exposure in the reservoir and on the applicator head.

SUMMARY

This summary is provided merely as an introduction and does not, by itself, limit the appended claims. In some aspects, the present invention is a kit that comprises at least two disposable first subassemblies and at least one reusable second subassembly, wherein each reusable second subassembly is able to be attached to a first subassembly such that a heat generating portion is disposed inside a hollow applicator head. Furthermore, each reusable second subassembly is able to be detached from the first subassembly such that the applicator head is removed from a reservoir, and becomes associated with the second subassembly. Each reusable second subassembly is able to be reconnected to the first subassembly such that the reservoir is sealed. Also, each reusable second subassembly can be detached from the applicator head, thus restoring the second subassembly to its original form.

DETAILED DESCRIPTION

A kit according to the present invention is intended for use with specific types of heating applicators. The specific types of heating applicators include those heating applicators described in co-pending application U.S. Ser. No. 13/330,765, the contents of which are herein incorporated by reference in their entirety. Such applicators comprise a first subassembly (FS) that is disposable and second subassembly (SS) that is reusable. The essential features of these subassemblies are now described, while a fuller description is provided in U.S. Ser. No. 13/330,765.

Figure 1C:
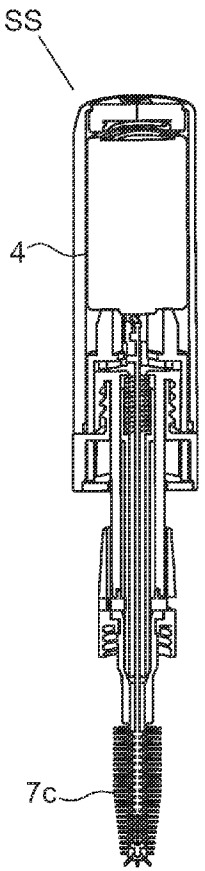
FIGS. 1A-C depict one embodiment of a specific type of heating applicator that may form part of a kit according to the present invention.
Figure 1B:
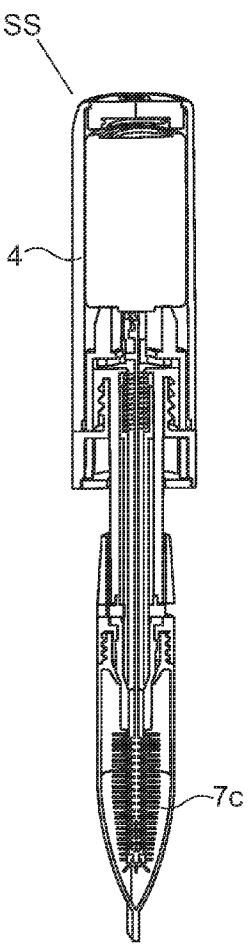
Figure 1A:
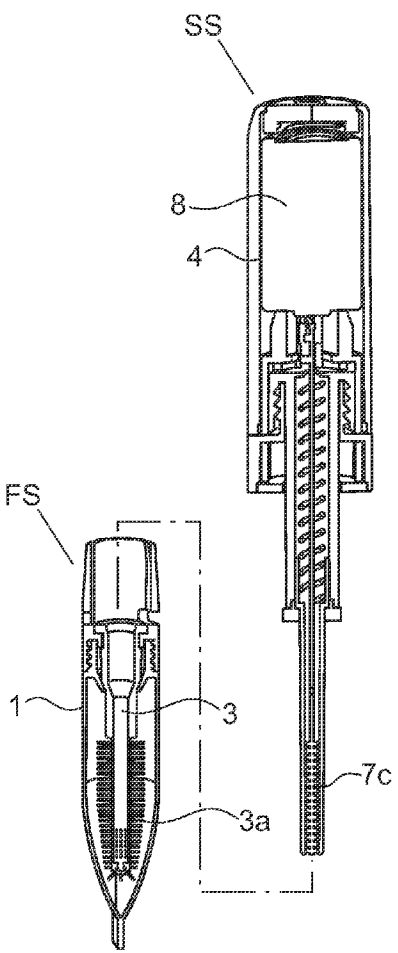
Figure 2A:
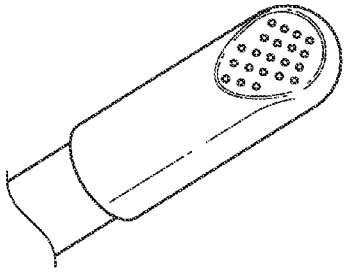
FIGS. 2A-K depict various applicator heads and working surfaces that may be used in the present invention.
Figure 2B:
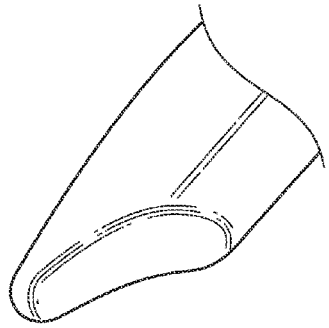
Figure 2C:
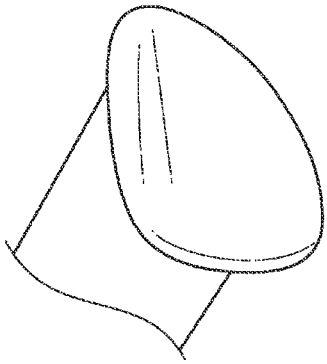
Figure 2D:
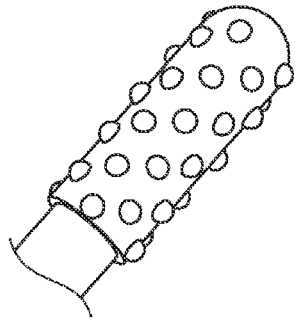
Figure 2E:
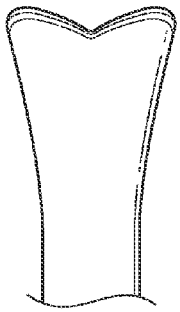
Figure 2F:
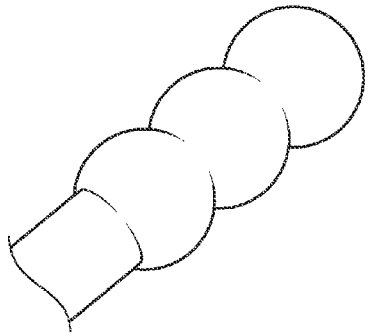
Figure 2G:
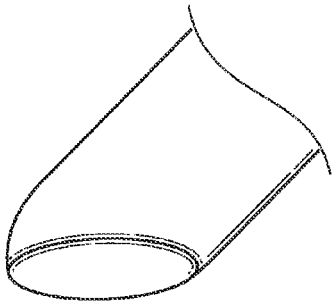
Figure 2H:
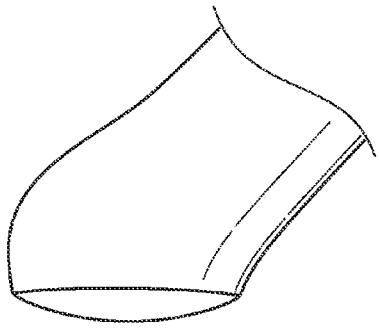
Figure 2I:
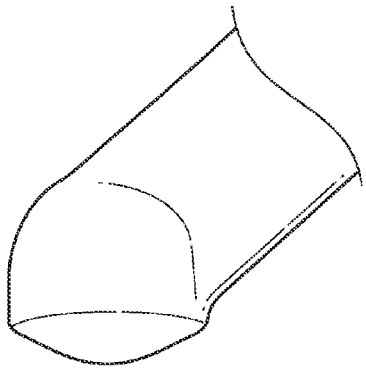
Figure 2J:
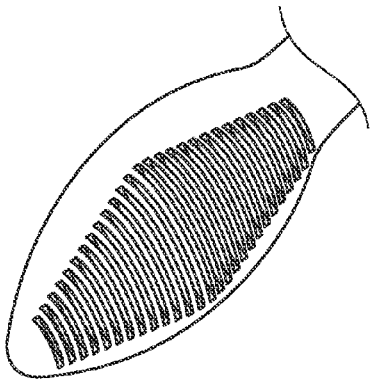
Figure 2K:
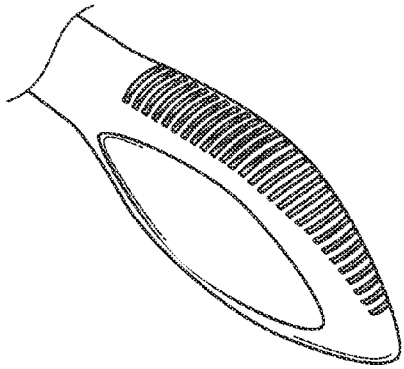

Referring to FIGS. 1A-1C, a disposable first subassembly (FS) comprises a reservoir (1) of product and a hollow applicator head (3). The hollow applicator head is initially mounted to the reservoir such that a working surface (3*a*) of the applicator head is in the reservoir. The mounting of the applicator head to the reservoir is effected in a way that allows the reservoir to be sealed prior to use, to protect the product in the reservoir from the ambient atmosphere.

The reusable second subassembly (SS) comprises a handle (4) and an electric heating circuit that comprises a heat generating portion (7*c*) that is connected to or able to be connected to a power source (8). The second subassembly is able to be attached to and detached from the first subassembly (FS). When a second subassembly is attached to a first subassembly in the intended manner, then the heat generating portion of the second subassembly is disposed inside the hollow applicator head (3) of the first subassembly. In this arrangement (see FIG. 1B), the heat generating portion is able to supply heat to product located in the reservoir (1) and/or on the applicator head.

Also, in this arrangement, a user can cause the second subassembly to remove the applicator head (3) from the reservoir (1), such that the applicator head becomes associated with (i.e. remains attached to) the second subassembly (SS; see FIG. 1C). As a result, when the second subassembly is detached from the first subassembly (FS), the applicator head is withdrawn from the reservoir. The second subassembly with applicator head attached, and the reservoir now serve as a conventional applicator and reservoir; i.e. a mascara package. For example, the applicator head can be inserted into the reservoir and removed to retrieve product from the reservoir. When not in use, the applicator head can be reinserted into the reservoir and the second subassembly can be connected to the first subassembly such that the product reservoir is again sealed until the next use. When the product in the reservoir is used up, then the reusable second subassembly can be detached from the applicator head, thus restoring the second subassembly to its original form. The applicator head and exhausted reservoir are disposed, while the second subassembly is reused with another first subassembly.

A principal advantage of this type of heating applicator is the ability to provide a consumer with a saleable amount of product (i.e. 4 to 10 grams of mascara) while avoiding over-exposure of the product to heat. Rather than providing a saleable amount of product in one reservoir, the product is distributed among several reservoirs in a kit with a reusable second subassembly (SS).

In summary, a kit according to the present invention comprises multiple first subassemblies and at least one second subassembly. The essential features of the first subassembly are a reservoir that is capable of holding a product and a hollow applicator head that is able to mount to the reservoir such that the product in the reservoir is sealed off from the ambient atmosphere. The essential features of the second subassembly are a handle; an electric heating circuit that includes a heat generating portion that is able to connect to a power source; the second subassembly is able to form a connection with the first subassembly such that the heat generating portion becomes disposed inside the hollow applicator head; and the second subassembly is able to remove the applicator head from the reservoir (1), such that the applicator head becomes associated with the second subassembly (SS). Thus, a kit according to the present invention comprises a set of disposable first subassemblies (FS) and at least on reusable second subassembly (SS) having at least the essential features just described.

The reservoirs (1) of the first subassemblies contain a relatively small amount of product, but enough product for more than one application, in contrast with the sample size reservoirs of co-pending application U.S. Ser. No. 12/980,526. In various embodiments, for example, the reservoirs may collectively contain a two week supply of product or less; preferably a ten day supply of product or less, more preferably a 5-7 day supply of product or less. Thus, by providing multiple product reservoirs, the amount of product that is subject to heating is limited, and the number of times that the product is subject to heating is much less than with a full size reservoir. Also, the lifetime of the reservoir is significantly reduced, so there is less time for the product to dry out or otherwise degrade even by ordinary exposure to the ambient atmosphere. Most preferably, when the product and applicator are used as intended, the amount of product contained in each reservoir is too little to experience significant degradation before the reservoir is exhausted. Furthermore, by providing multiple applicator heads, there is virtually no chance, in normal, intended use, for applicator function to be significantly impaired by product dry out on the applicator head.

We have observed that if the amount of product contained in a reservoir (1) herein described is not too great, then the contents of the reservoir may be used up without significant degradation of the product in the reservoir occurring as a result of the heated applicator. For example, a reservoir that contains enough product for 7-14 applications with a heated applicator may be used up before significant degradation occurs. Preferably, a reservoir for use with a heated applicator as described herein, contains enough product for no more than 14 applications; more preferably, enough product for no more than 7 applications. In order to achieve a specified number of applications, the actual amount of product filled in the reservoir will depend on the type of product and the ability of the applicator to evacuate product from the reservoir. In one preferred embodiment, a reservoir holds about 1-2 mL of a product, such as mascara, which may provide 1-4 applications. In another preferred embodiment, each reservoir holds about 2-4 mL of a product, such as mascara, which may provide about 2-14 applications. In some embodiments of a kit according to the present invention, the first subassemblies collectively contain from 1-20 mL of product; in other embodiments from 2-10 mL of product; in still other embodiments from 4-8 mL of product.

In some embodiments, a kit according to the present invention comprises from 2-52 first subassemblies (FS) each having a 7-application reservoir (1) (i.e. nominally, a two week to a one year supply). Or, for example, a kit according to the present invention may comprise a single reusable second subassembly (SS) and from 2-26 first subassemblies each having a 14-application reservoir (i.e. nominally, a four week to a one year supply). Because each reservoir in the kit is sealed air tight prior to use, any number of first subassemblies may be provided in the kit with a reusable second subassembly. In practice however, the number of first subassemblies provided in a kit to the consumer may be limited by market acceptance. Therefore, in some embodiments, a kit according to the present invention comprises 2-28 first subassemblies, preferably 2-14 first subassemblies, more preferably 4-14 first subassemblies, more preferably still 4-8 first subassemblies. Or, for example, the kit may comprise enough reservoirs for one month of use, or three months of use or six months of use, wherein the number of reservoirs depends on the product fill level of each reservoir. All the reservoirs in a single kit may have the same fill level or a single kit may comprise reservoirs of differing fill levels.

Optionally, all the reservoirs (1) in a kit may have the same product or a single kit may comprise reservoirs having any number of differing products. For example, a single kit with differing products might include two of the most popular mascara products, or four, or any number. Or, for example, a single kit may comprise one or more reservoirs that contain one or more general use mascaras, and one or more reservoirs that contain one or more transfer-resistant and/or water resistant mascaras. Alternatively, a single kit with differing products might include one or more mascara formulations with one or more non-mascara formulations. For example, a single kit may comprise one or more mascara products and one or more non-mascara products, such as lip gloss, lipstick, foundation, a skin treatment product, such as an anti-acne product, a moisturizer, etc. Alternatively, a single kit with differing products might include one or more shades of the same base product. For example, a single kit may comprise reservoirs having any number of different colors of mascara, such as two or four or six different colors of the same base formulation.

Within a kit according to the present invention, the working surfaces (3*a*) of the applicator heads (3) of the first subassemblies (FS) may be all the same or the kit may comprise two or more types of working surfaces. The different types of working surfaces may be chosen to accommodate different types of products included in the kit, or the different applicator heads may be chosen to offer a variety of application experiences in applying a single product. For example, if the product is a mascara, then the kit should comprise at least one applicator head of a type known to be used for mascara application, like a bristle brush and/or comb having spaced apart bristles. Or, for example, if the product is a face cream, then a working surface of the applicator head may comprise an extended, smooth surface, specifically contoured for delivering product to portions of the face. Some examples of various types of applicator heads and working surfaces are shown in FIGS. 2A-2K. 2A depicts an acne treatment applicator; 2B an eyelid makeup applicator; 2C an applicator for targeting product to lines and wrinkles; 2D and 2E are sculpting applicators; 2F an under makeup or treatment eye applicator; 2G-2I depict hyper pigmentation applicators of increasing degree of specificity; 2J and 2K depict lip product applicators. This list of not exhaustive. Virtually any type of applicator may be provided in a kit according to the present invention provided it can be integrated into a first subassembly (FS) as described herein.

In a kit according to the present invention, there is at least one second subassembly (SS). In general, more than on second subassembly may be provided, but in most circumstances this may not be necessary, especially if the power source (8) can be changed or recharged. A kit may further comprise a recharging base that is able to facilitate recharging of the power source of the second subassembly.

Figure 7:
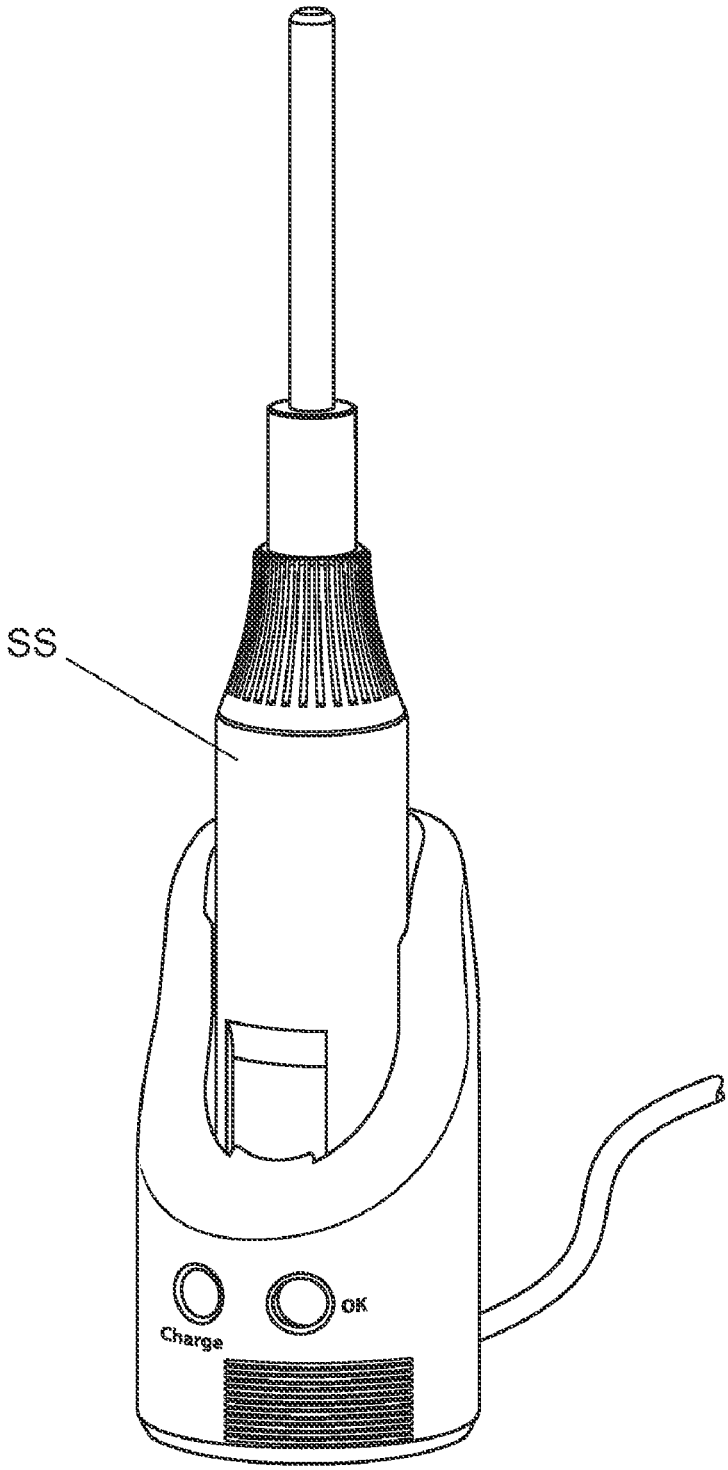
FIG. 7 shows one example of a recharging base that may form part of a kit according to the present invention.

A preferred kit according to the present invention comprises one second subassembly (SS), at least four first subassemblies (FS) all containing a mascara product; more preferably at least eight first subassemblies. Another preferred kit comprises one second subassembly, multiple first subassemblies, and a recharging base that is able to effectively recharge the second subassembly. An example of a recharging base (30) that may form part of a kit according to the present invention is shown in FIG. 7.

Inner and Outer Packaging

Figure 3:
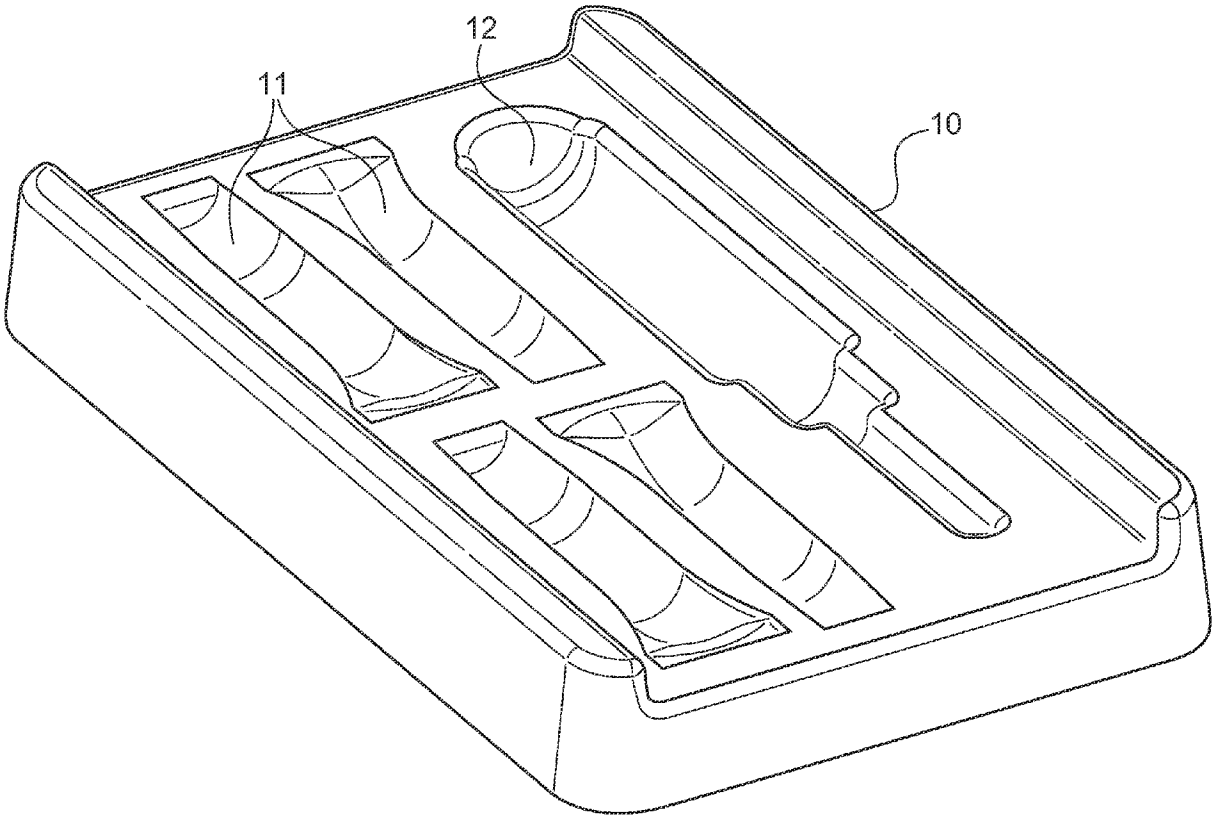
FIGS. 3 and 4 depict one example of a molded tray that may be useful with a kit according to the present invention.
Figure 4:
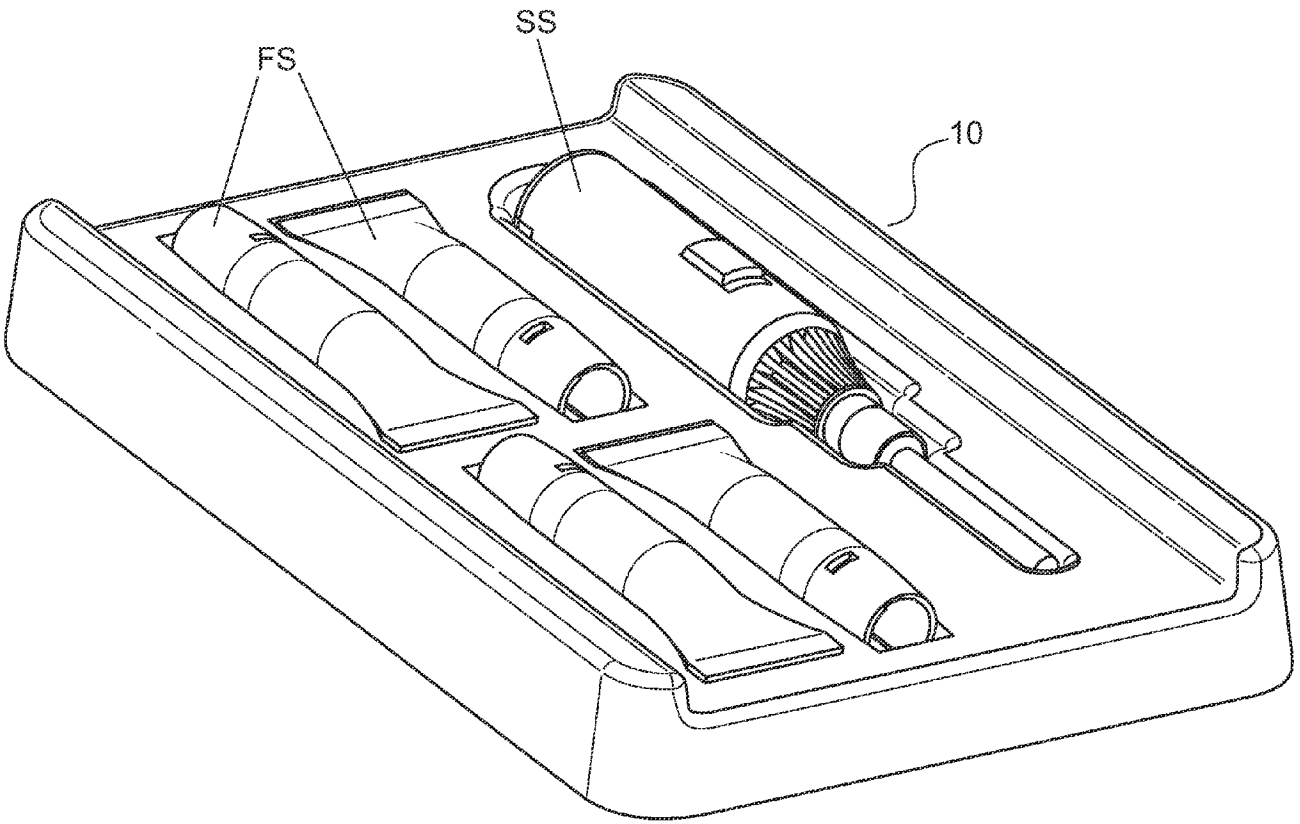
Figure 5:
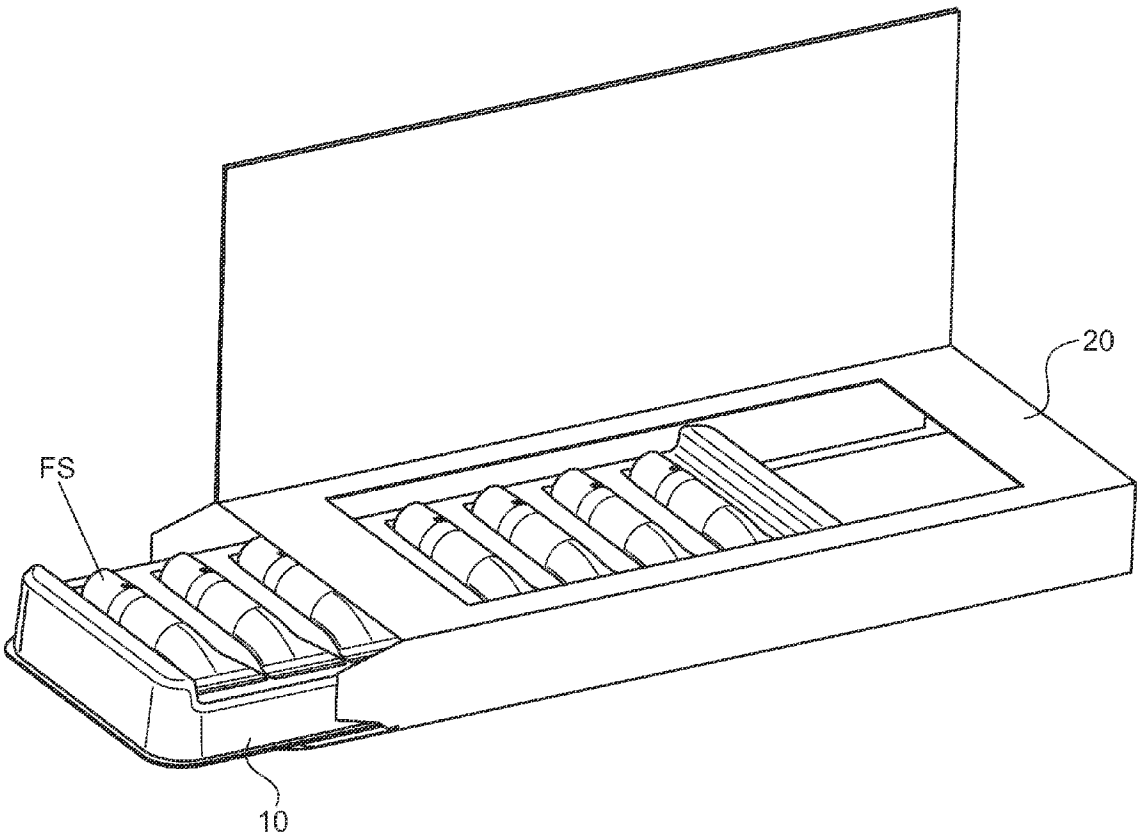
FIGS. 5 and 6 depict two more examples of molded trays that may be useful with a kit according to the present invention.
Figure 6:
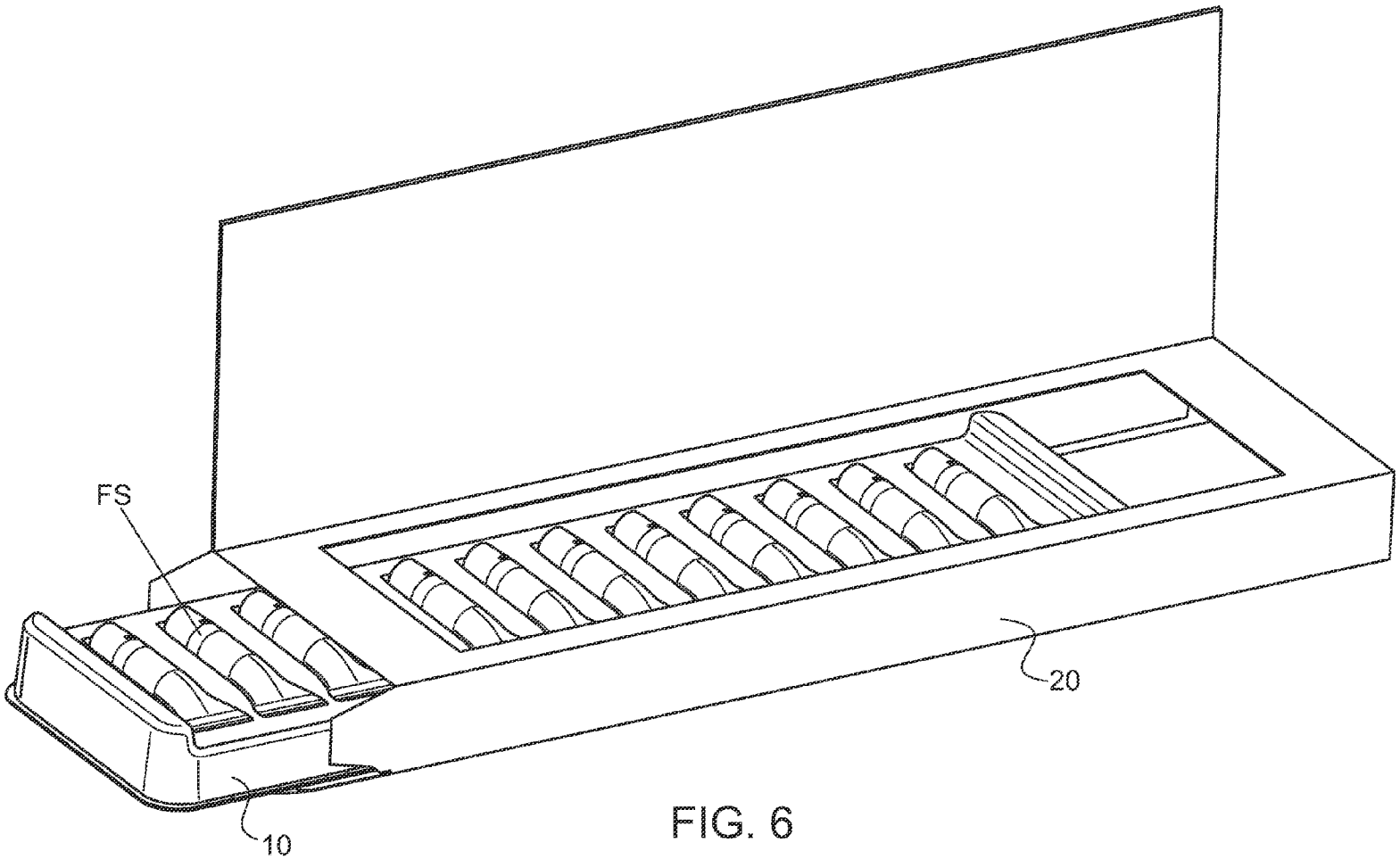

As noted, a kit according to the present invention comprises two or more first subassemblies (FS) and at least one second subassembly (SS). Optionally, for distribution, sales appeal and consumer convenience, the two or more first subassemblies may be disposed in a carton or other packaging designed to securely hold and/or display the first subassemblies. For example, referring to FIGS. 3-6, a plastic molded tray (10) may be provided that has multiple first sections (11), each first section molded to the shape of a first subassembly that is disposed therein. Preferably, there are as many molded first sections as there are first subassemblies in the kit; i.e. 4 or 8 or 12 or 14 or 21 or 28 or 52, etc. Optionally, a molded tray has at least one molded second section (12). The second section is molded to the shape of a second subassembly to securely hold the second subassembly. This is shown in FIGS. 3 and 4. Optionally, the molded tray may comprises additional molded sections that are shaped to receive and hold other articles, such as batteries or a recharging base.

Optionally, the kit may be provided to a consumer in one or more outer packages (20). Optionally, a molded tray (10) may be housed in the outer package (see FIGS. 5 and 6). Optionally, the outer package may contain instructions for use of the dispenser, or the outer package may direct a user to instructions for use. For example, instructions for use may be printed on a substrate that is included in the outer packaging. Alternatively, the outer packaging may direct the user to a website where instructions for use can be viewed on a monitor. Instructions for use may include some or all of the following: how to assemble the second subassembly to the one or more first subassemblies; how to turn on the heating elements, how long to wait for product to heat before applying, how to turn off the heating elements, how to access and change a battery, how to recharge a battery, how to detach an applicator head from the second subassembly, how to dispose of any part of the system. Optionally, the outer packaging may include one or more batteries intended to power the heating generating portion of the second subassembly. Optionally, the outer packaging may include a recharging base (30).

What is claimed is:

1. A kit comprising at least two disposable first subassemblies and at least one reusable second subassembly, wherein:

each disposable first subassembly (FS) comprises a reservoir (1) of product and a hollow applicator head (3) that is initially mounted to the reservoir such that the reservoir is sealed from the ambient atmosphere, and such that a working surface (3*a*) of the applicator head is disposed in the reservoir;

each reusable second subassembly (SS) comprises a handle (4) and an electric heating circuit that comprises a heat generating portion (7*c*) that is able to be connected to a power source (8);

each reusable second subassembly (SS) is able to be attached to the first subassembly (FS) such that the heat generating portion (7*c*) is disposed inside the hollow applicator head (3);

each reusable second subassembly (SS) is able to be detached from the first subassembly (FS) such that the applicator head (3) is removed from the reservoir (1), and becomes associated with the second subassembly;

each reusable second subassembly (SS) is able to be reconnected to the first subassembly such that the product reservoir is again sealed; and each reusable second subassembly (SS) can be detached from the applicator head (3), thus restoring the second subassembly to its original form.

2. A kit according to claim 1 wherein the reservoirs of the two or more first subassemblies collectively contain a two week supply of product or less.

3. A kit according to claim 1 wherein the reservoirs of the two or more first subassemblies collectively contain from 1-20 mL of product.

4. A kit according to claim 3 wherein the reservoirs of the two or more first subassemblies collectively contain from 2-10 mL of product.

5. A kit according to claim 4 wherein the reservoirs of the two or more first subassemblies collectively contain from 4-8 mL of product.

6. A kit according to claim 1 comprising from 2-52 first subassemblies (FS).

7. A kit according to claim 6 comprising from 2-14 first subassemblies (FS).

8. A kit according to claim 7 comprising from 4-8 first subassemblies (FS).

9. A kit according to claim 1 wherein all of the reservoirs (1) do not contain the same product.

10. A kit according to claim 9 wherein at least one of the products is a mascara.

11. A kit according to claim 9 wherein at least one of the products is a skin treatment product.

12. A kit according to claim 1 wherein all of the applicator heads (3) are not the same type.

13. A kit according to claim 12 wherein at least one of the applicator heads is a mascara applicator head.

14. A kit according to claim 1 wherein the first subassemblies are disposed in a molded tray that has multiple first sections (11) that are molded to the shapes of the first subassemblies.

15. A kit according to claim 14 wherein the tray has at least one molded second section (12) that is molded to the shape of a second subassembly.

16. A kit according to claim 1 further comprising a recharging base.

* * * * *